US007355138B2

(12) United States Patent
Chou

(10) Patent No.: US 7,355,138 B2
(45) Date of Patent: Apr. 8, 2008

(54) SIMPLIFIED PUSHBUTTON SWITCH

(75) Inventor: Chin-Wen Chou, Taipei Hsien (TW)

(73) Assignee: Zippy Technology Corp., Hsin-Tien (TW)

( * ) Notice: Subject to any disclaimer, the term of this patent is extended or adjusted under 35 U.S.C. 154(b) by 0 days.

(21) Appl. No.: 11/514,262

(22) Filed: Sep. 1, 2006

(65) Prior Publication Data

US 2008/0053807 A1 Mar. 6, 2008

(51) Int. Cl.
*H01H 13/14* (2006.01)
*H01H 3/12* (2006.01)

(52) U.S. Cl. ..... 200/341; 200/520

(58) Field of Classification Search ..... 200/341, 200/520

See application file for complete search history.

(56) References Cited

U.S. PATENT DOCUMENTS 6,222,144 B1 * 4/2001 Nishikawa ..... 200/537
6,248,966 B1 * 6/2001 Nakase et al. ..... 200/557
6,903,293 B2 * 6/2005 Sasaki ..... 200/339
7,005,588 B2 * 2/2006 Pihlaja ..... 200/5 A
7,138,594 B2 * 11/2006 Hu et al. ..... 200/520

FOREIGN PATENT DOCUMENTS

TW 367086 8/1999
TW M248007 U 10/2004

* cited by examiner

*Primary Examiner*—Anh Mai
*Assistant Examiner*—Lheiren Mae A. Anglo
(74) *Attorney, Agent, or Firm*—Birch, Stewart, Kolasch & Birch, LLP

(57) ABSTRACT

A simplified pushbutton switch includes a circuit board which has a signal circuit consisting of a common contact and at least one signal contact, a main bracket which has an anchor end on one end to couple with the circuit board and a force receiving end on another end formed by extending the anchor end through at least one bend point that is movable reciprocally about the anchor end which serves as an axis, and a conductive member which is located on the main bracket and has at least two legs corresponding to the signal circuit. The force receiving end can receive an external force to move towards the circuit board about the bend point such that the two legs are driven to connect the common contact and the signal contact to form a conductive condition to output at least one command signal.

13 Claims, 11 Drawing Sheets

SIMPLIFIED PUSHBUTTON SWITCH

FIELD OF THE INVENTION

The present invention relates to a switch and particularly to a simplified pushbutton switch.

BACKGROUND OF THE INVENTION

Reference of microswitches used in electronic devices to generate command signals can be found in R.O.C. Patent Publication No. 367086 or R.O.C. Patent No. M248007 (referring to FIG. 1). They are mostly made in a small size. Aside from different designs in conductive elastic reeds to transfer command signals, they all have a switch shell and signal legs to transfer the command signals outside the switch shell. The circuit board of the electronic devices has preset contacts to connect to the signal legs. Such switches have to provide accurate displacement control. Depression click feeling also is important. In terms of these issues, the conventional switches mentioned above still have rooms for improvement, notably:

1. Miniaturization is the prevailing trend of design of electronic devices. The internal space of the electronic devices shrinks. As the conventional switch needs the shell, it is difficult to fit in the limited space.

2. After the switch is mounted onto the circuit board, the signal legs have to be soldered. Such a process increases production time. This secondary fabrication process also could result in damage of the circuit board or other elements.

3. The conventional switches mostly aim to output a signal command signal. These days many electronic devices require multiple command signals. Hence a plurality of switches is needed. This further increases the configuration difficulty in the limited space.

SUMMARY OF THE INVENTION

In view of the aforesaid problems occurred to the conventional switches, the present invention aims to provide a simplified pushbutton switch that has a simplified structure and reduced production cost. The invention has a signal circuit on a circuit board and a conductive member to connect the signal circuit to generate a command signal. Hence no secondary fabrication process is needed after the switch has been fabricated and assembled. Total element number is smaller. Fabrication of the switch is simpler.

According to an embodiment, the invention includes a circuit board which has a signal circuit consisting of a common contact and at least one signal contact, a main bracket which has an anchor end on one end to be coupled with the circuit board and a force receiving end on another end formed by extending the anchor end through at least one bend point that is movable reciprocally about the anchor end which serves as an axis, and a conductive member located on the main bracket that has two legs. The force receiving end receives an external force to move towards the circuit board based on the bend point so that the two legs of the conductive member are driven to connect to the common contact and the signal contact to form a conductive condition to output at least one command signal. The simplified pushbutton switch thus formed can output the command signal through connection of the common contact and the signal contact. During fabrication, the conductive member is mounted onto the main bracket. The structure is simpler, and production yield is higher.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
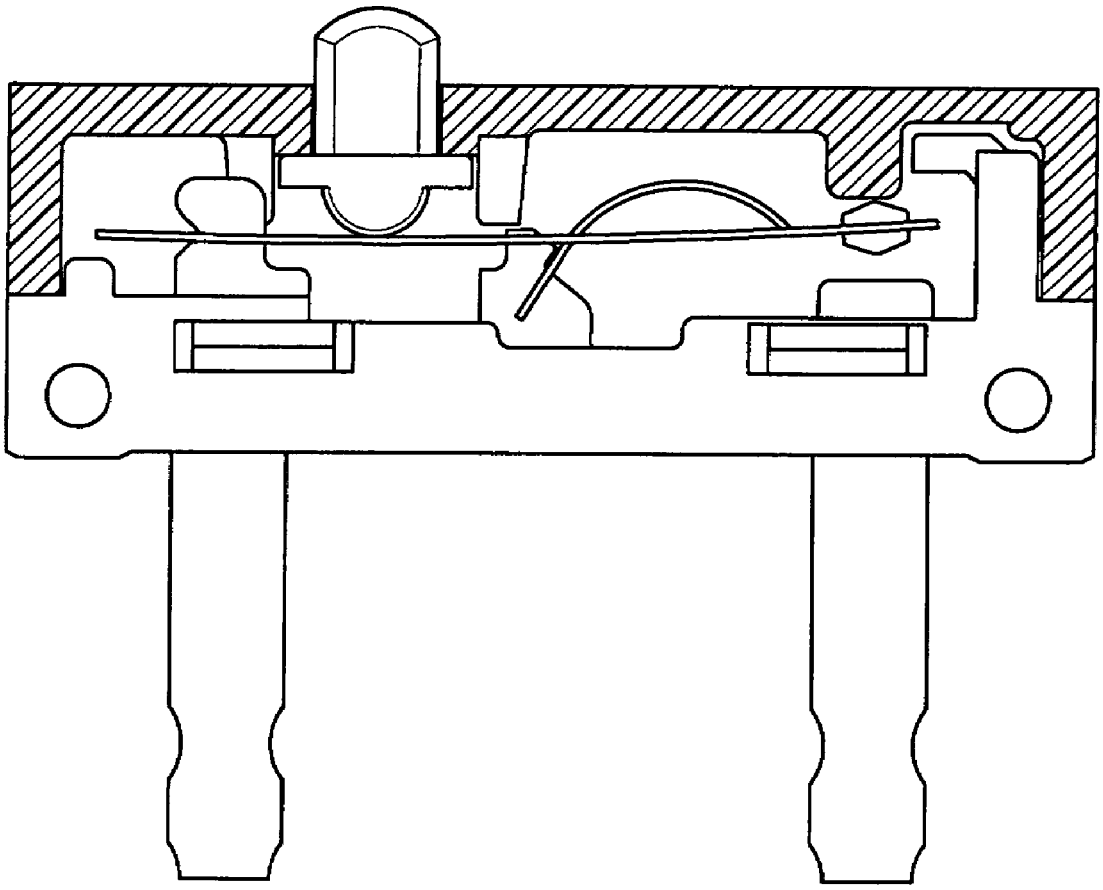
Fig. 1 PRIOR ART
FIG. 1 is a sectional view of a conventional pushbutton switch.
Figure 2:
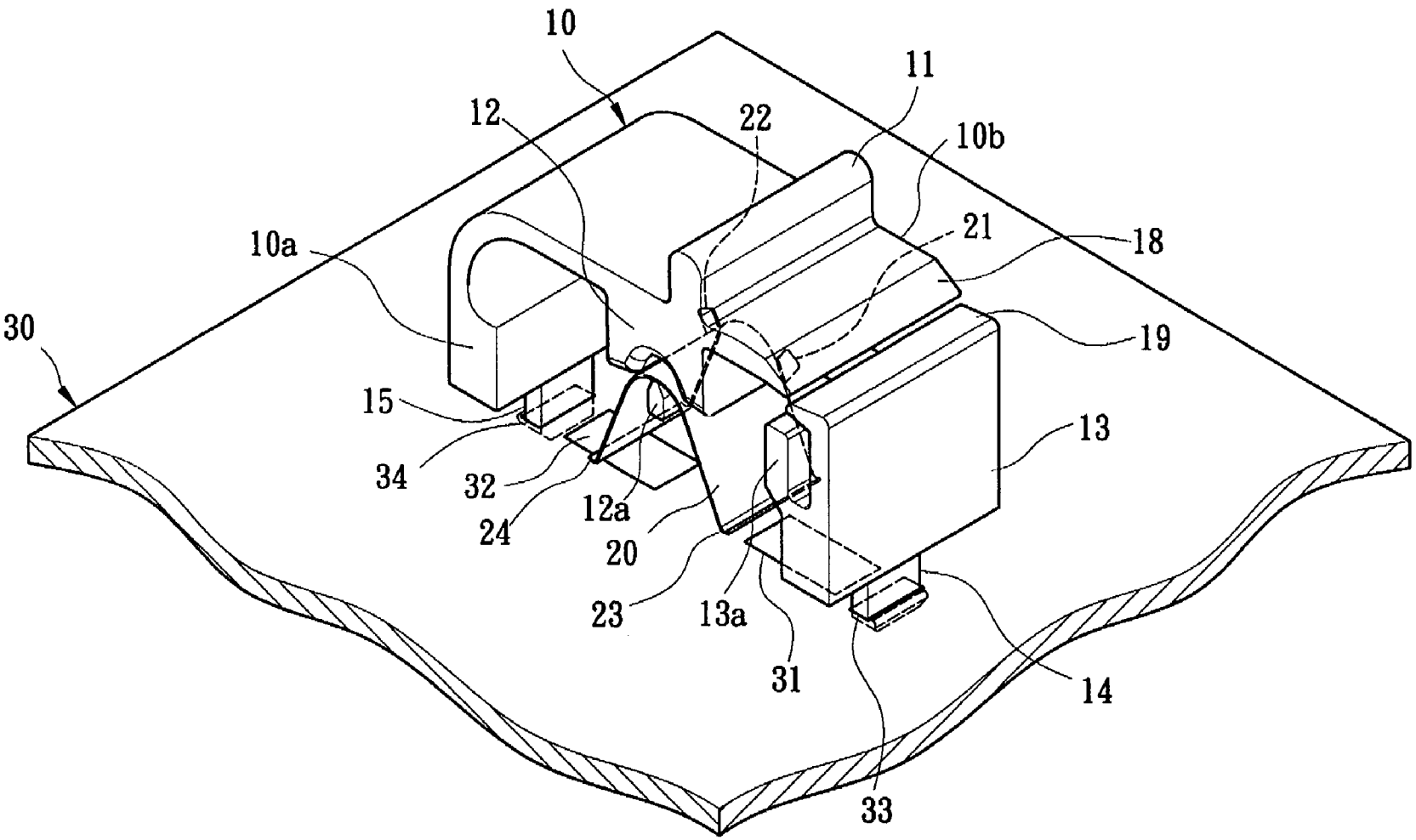
FIG. 2 is a perspective view of an embodiment of the invention.
Figure 3:
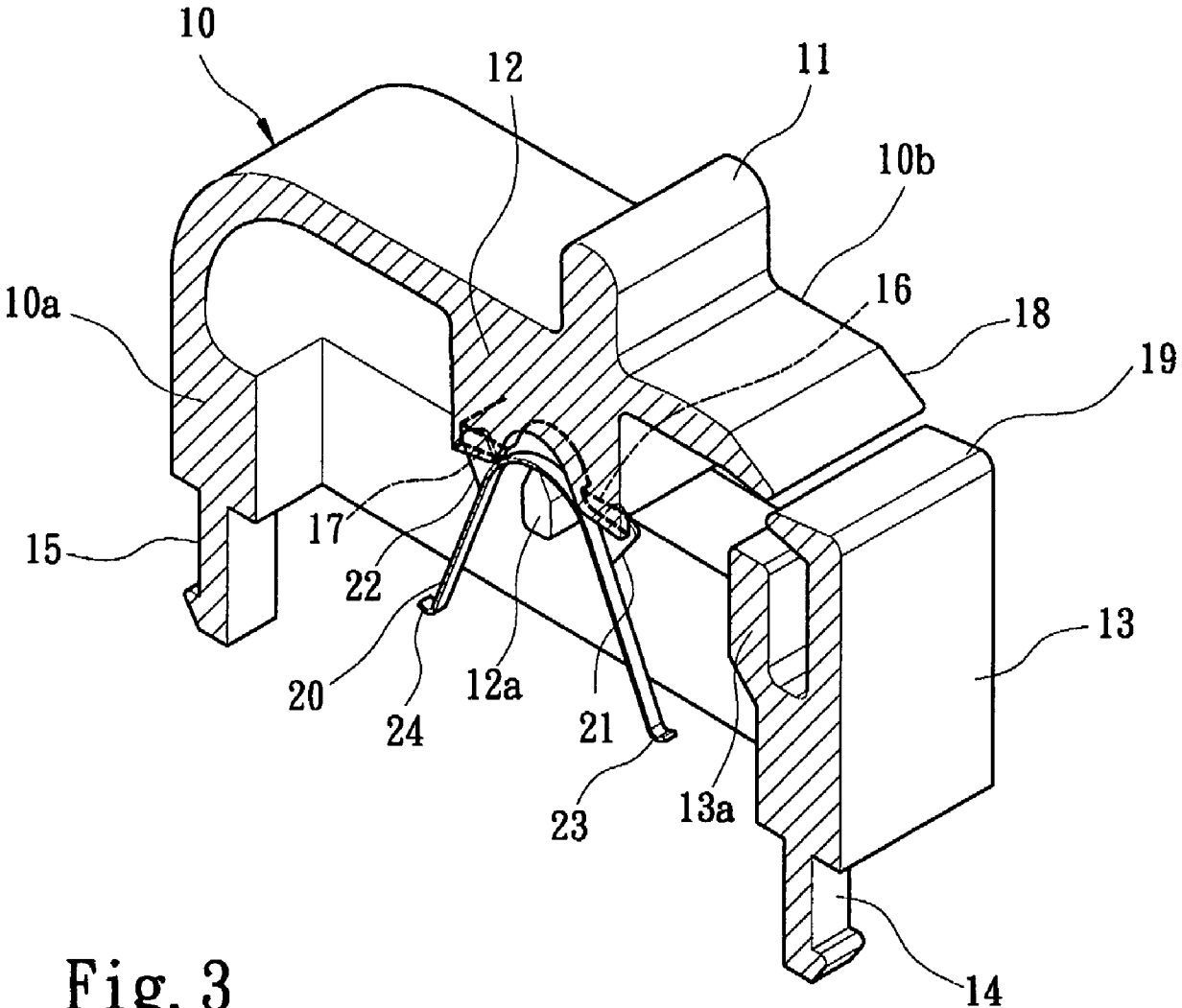
FIG. 3 is a perspective cut off view of an embodiment of the invention.
Figure 4:
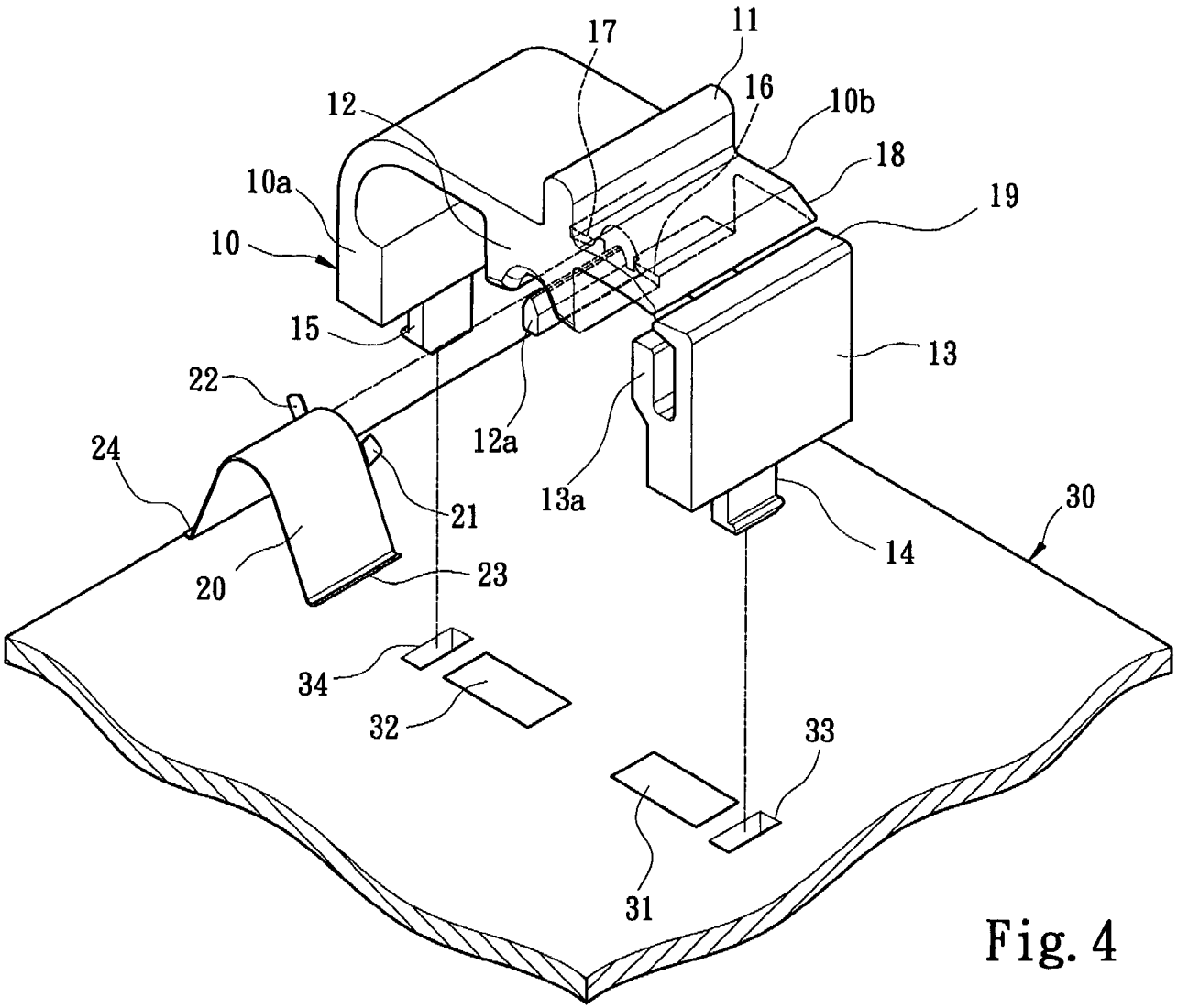
FIG. 4 is an exploded view of an embodiment of the invention.
Figure 5:
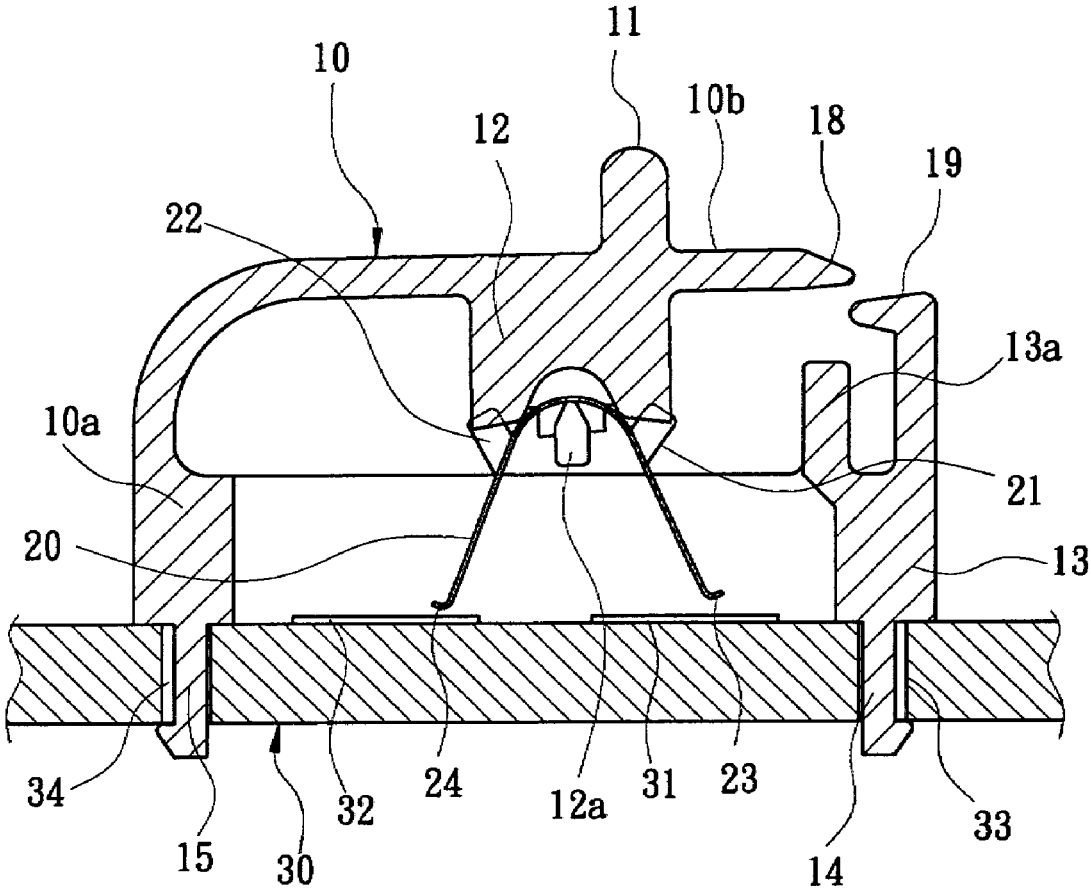
FIG. 5 is a sectional view of an embodiment of the invention.

Please refer to FIGS. 2 through 5 for an embodiment of the invention. The simplified pushbutton switch of the invention includes a circuit board 30, a main bracket 10, a conductive member 20 and a sub-bracket 13. The circuit board 30 has a signal circuit consisting of a common contact 31 and a signal contact 32. The main bracket 10 has an anchor end 10*a* on one end to be coupled with the circuit board 30, and a force receiving end 10*b* on another end formed by extending the anchor end 10*a* through at least one bend point that is movable reciprocally about the anchor end 10*a* which serves as an axis. The reciprocal movement of the force receiving end 10*b* forms a free position and a forced conductive position. The circuit board 30 has a first anchor hole 34. The anchor end 10*a* of the main bracket 10 has a first retaining portion 15 corresponding to the first anchor hole 34. The main bracket 10 further has a depressing portion 11 formed by extending the force receiving end 10*b* upwards. The conductive member 20 is located on the main bracket 10 which has a holding space to hold the conductive member 20. The holding space includes a first holding trough 16 and a second holding trough 17, an anchor portion 12 and an anchor strut 12*a*. The conductive member 20 is located between the anchor portion 12 and the anchor strut 12*a*, and has a first holding portion 21 and a second holding portion 22 corresponding to the first and second holding troughs 16 and 17. The conductive member 20 further has at least two legs 23 and 24 corresponding to the signal circuit. While the force receiving end 10*b* receives an external force and moves towards the circuit board 30 about the bend point, the two legs 23 and 24 are driven in contact with the common contact 31 and the signal contact 32 to form a conductive condition to output a command signal. The sub-bracket 13 has a first pressing portion 18 and a second pressing portion 19 corresponding to the main bracket 10. While the force receiving end 10*b* of the main bracket 10 is moved, the first pressing portion 18 is driven synchronously to press the second pressing portion 19 to generate a click feeling for the pushbutton switch. The sub-bracket 13 also has a second retaining portion 14 corresponding a second anchor hole 33.

Figure 6A:
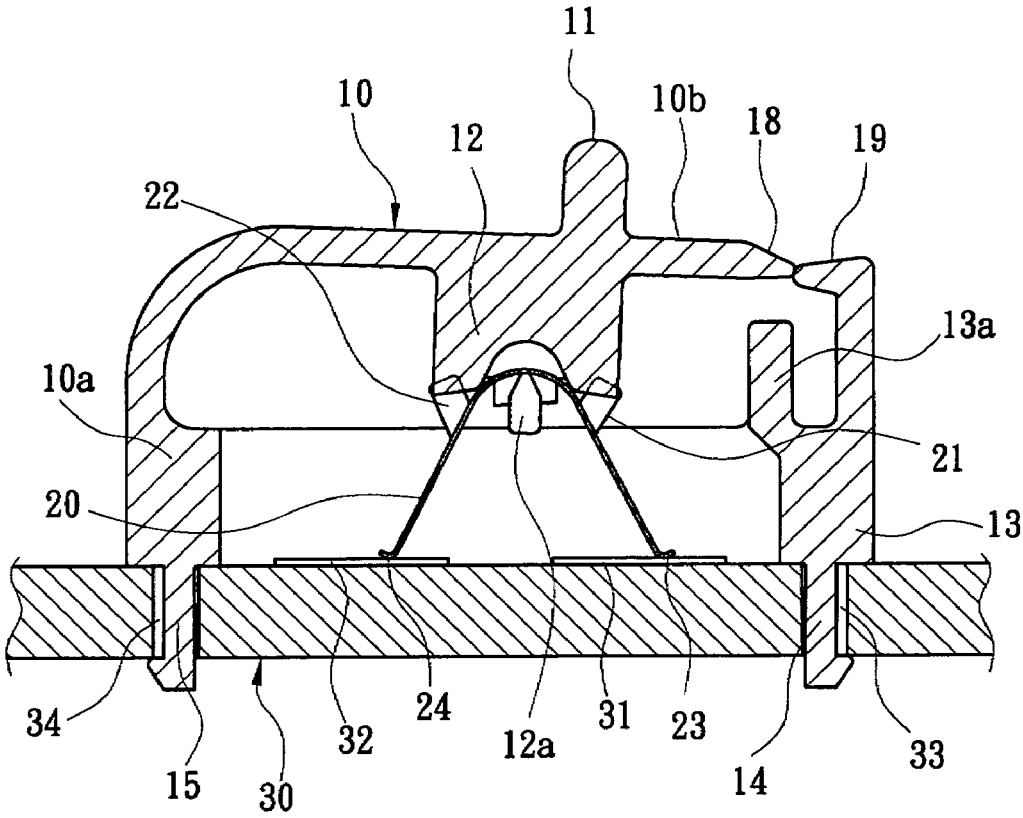
FIGS. 6A through 6D are sectional views and top views of an embodiment of the invention in operating conditions.
Figure 6B:
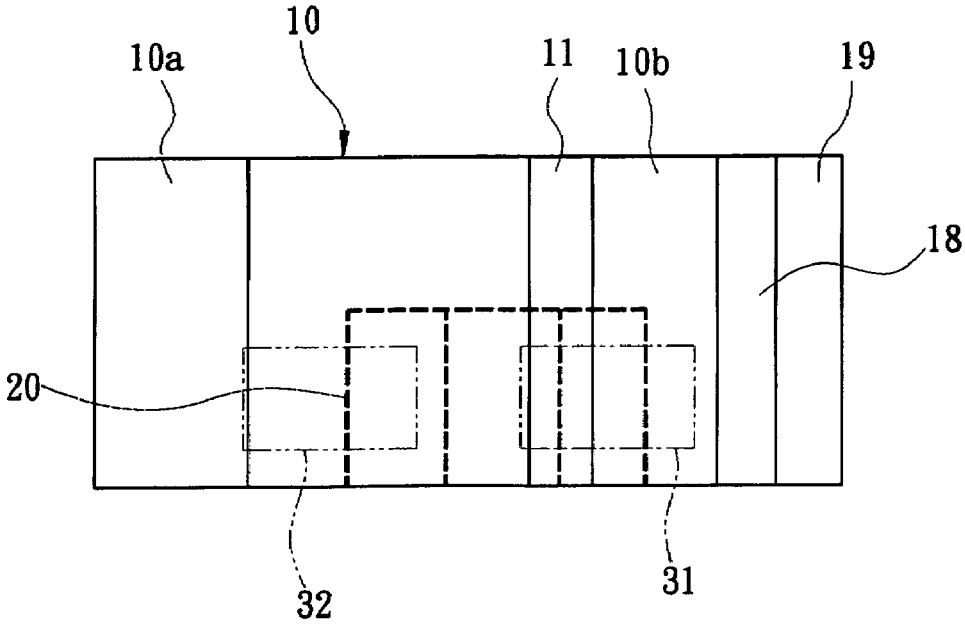
Figure 6C:
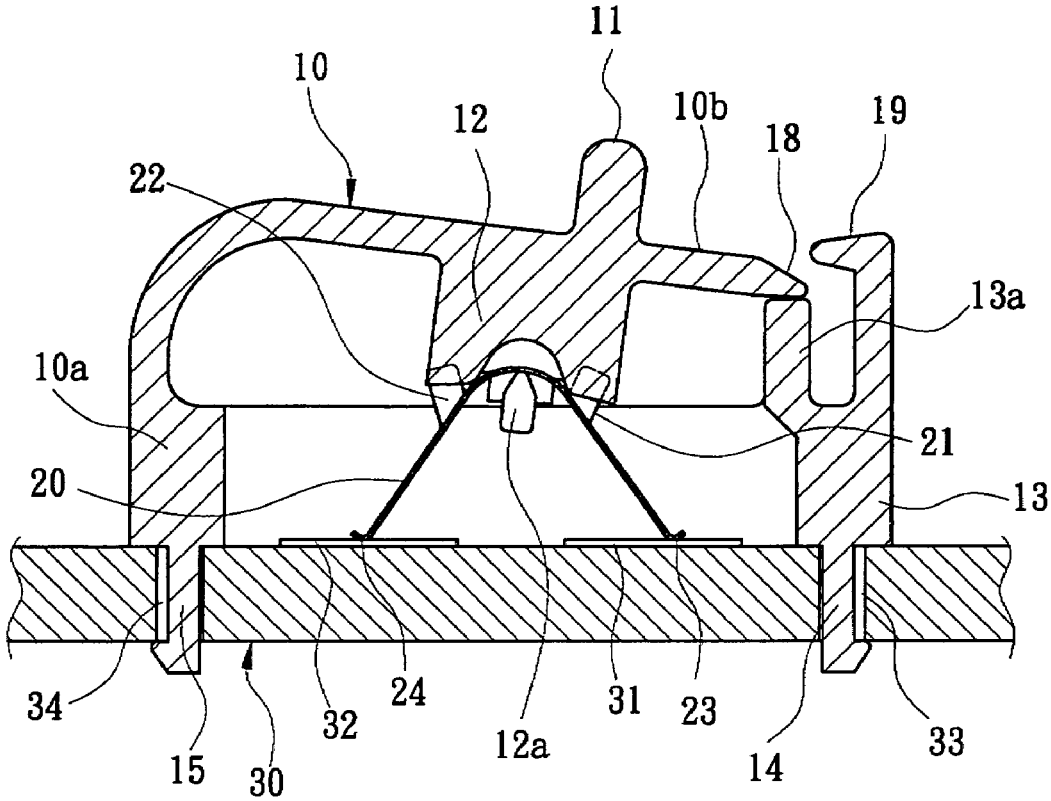
Figure 6D:
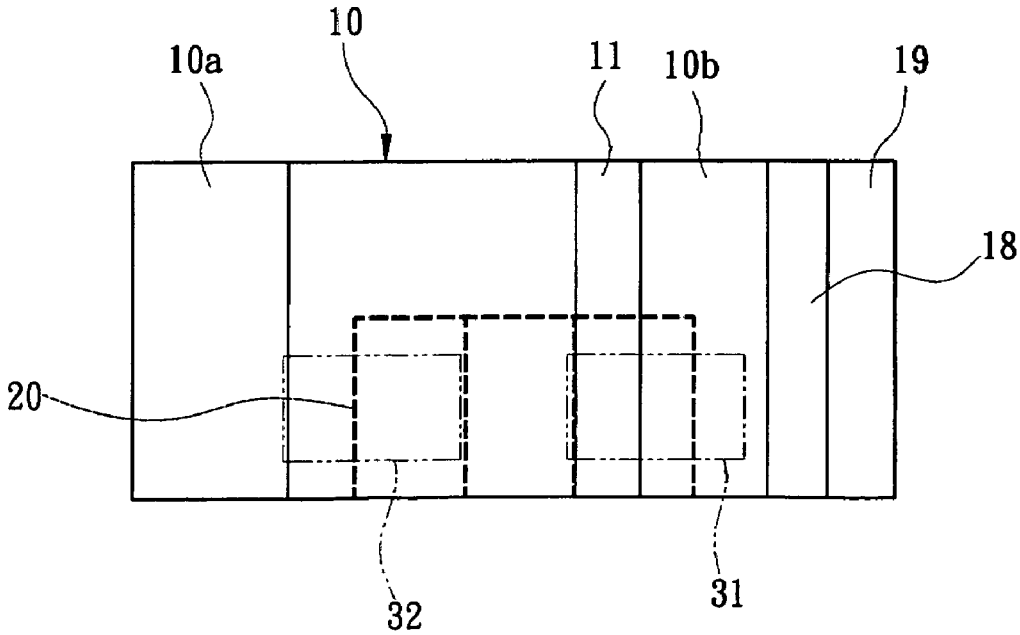

Refer to FIGS. 6A through 6D for the embodiment of the invention set forth above in operating conditions. While the force receiving end 10*b* is moved about the bend point under the external force towards the circuit board 30, the two legs 23 and 24 of the conductive member 20 are driven to connect the common contact 31 and the signal contact 32 to form a conductive condition to output a command signal. Meanwhile, the first pressing portions 18 is driven to press the second pressing portion 19 to generate a click feeling for the pushbutton switch after the conductive condition is formed. The sub-bracket 13 has a bucking portion 13*a* to limit the moving displacement of the first pressing portion 18 to prevent the force receiving portion 10*b* from bending too much and broken.

Figure 7A:
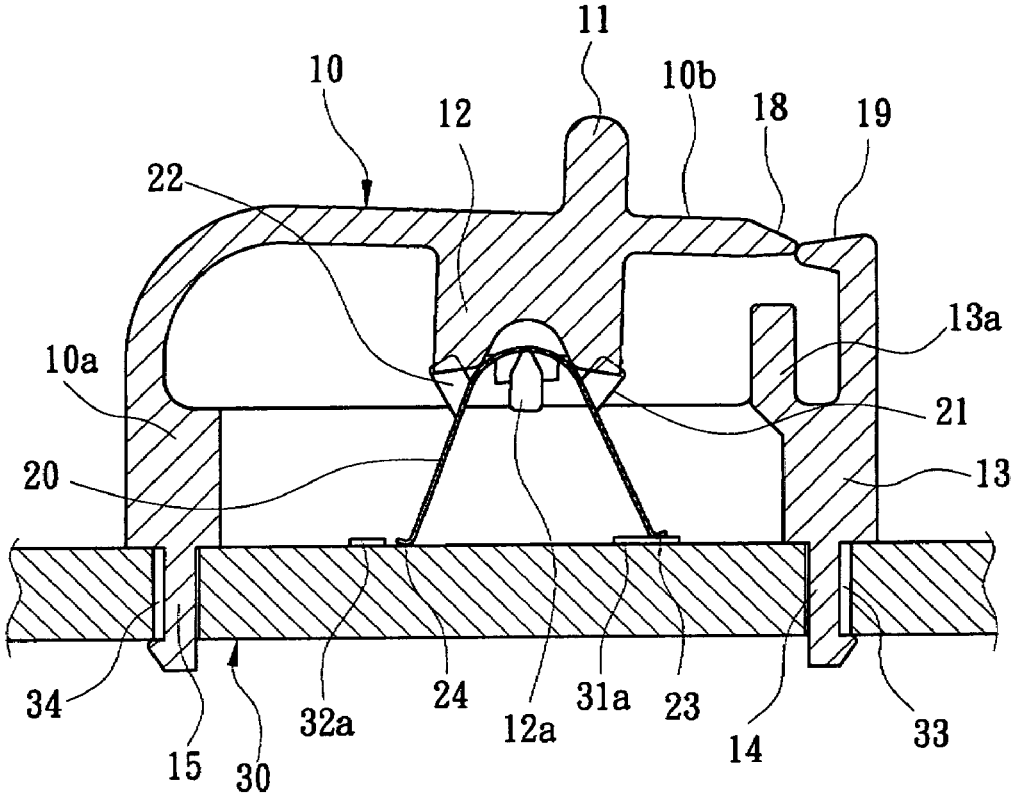
FIGS. 7A through 7D are sectional views and top views of a second embodiment of the invention in operating conditions.
Figure 7B:
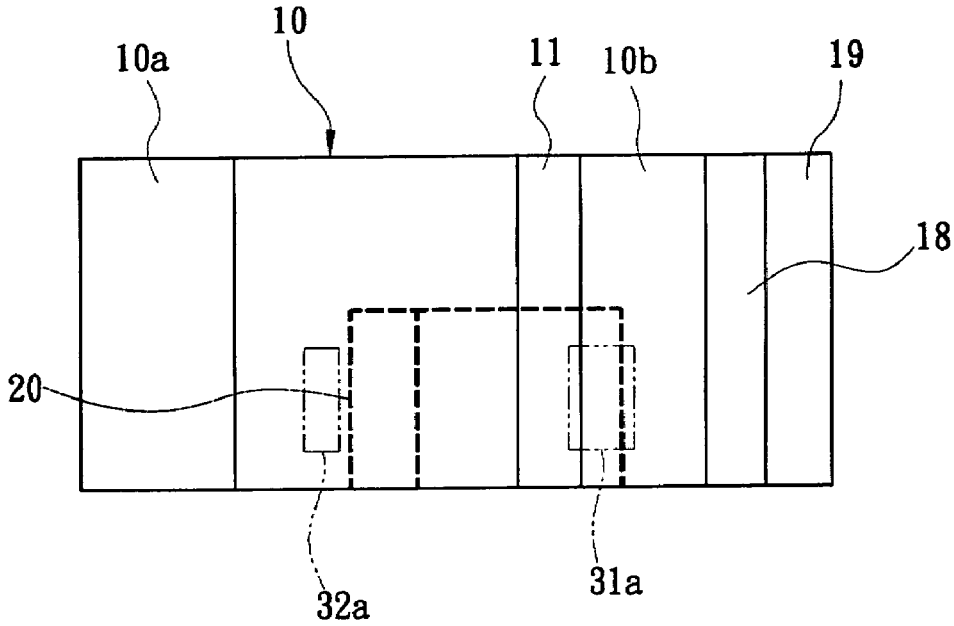
Figure 7C:
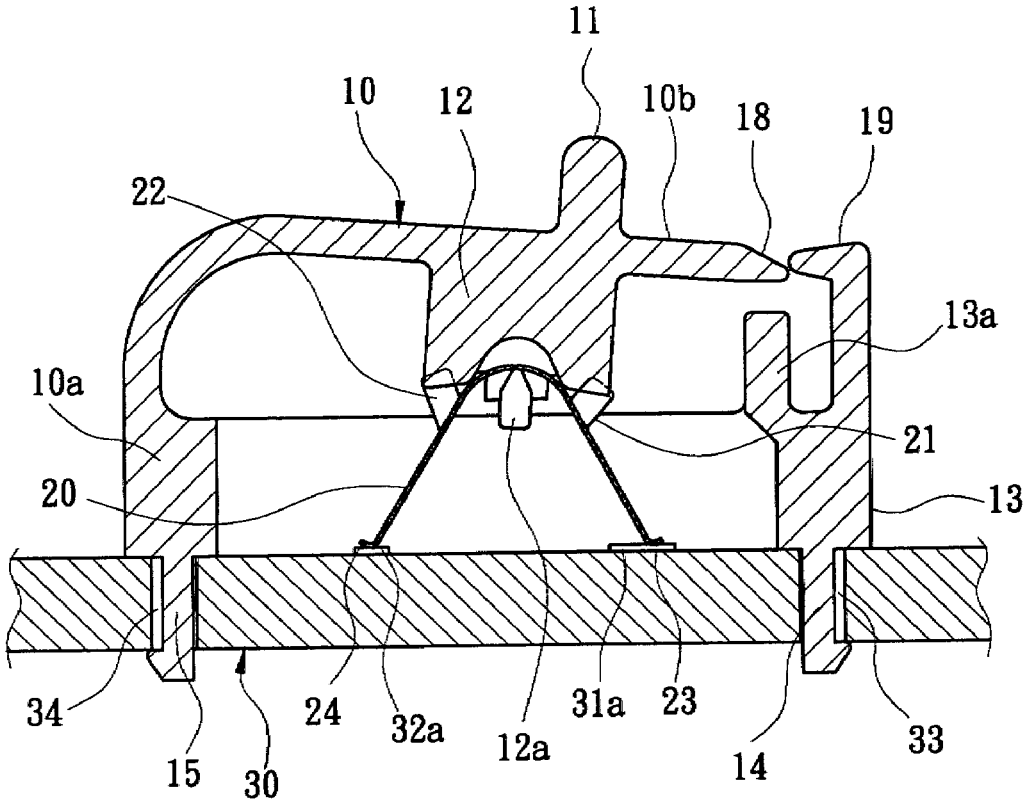
Figure 7D:
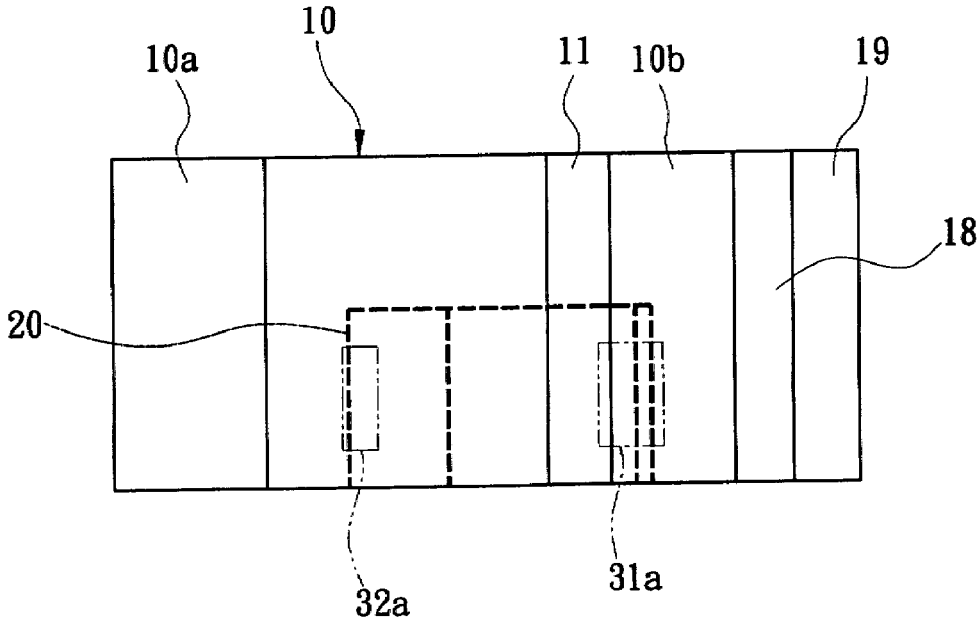

Refer to FIGS. 7A through 7D for a second embodiment of the invention in operating conditions. While the force receiving end 10*b* is moved about the bend point under the external force towards the circuit board 30, the two legs 23 and 24 of the conductive member 20 are driven to connect the common contact 31*a* and the signal contact 32*a* to form a conductive condition to output a command signal. Meanwhile, the first pressing portions 18 is driven to press the second pressing portion 19 to generate a click feeling for the pushbutton switch before the conductive condition is formed.

Figure 8A:
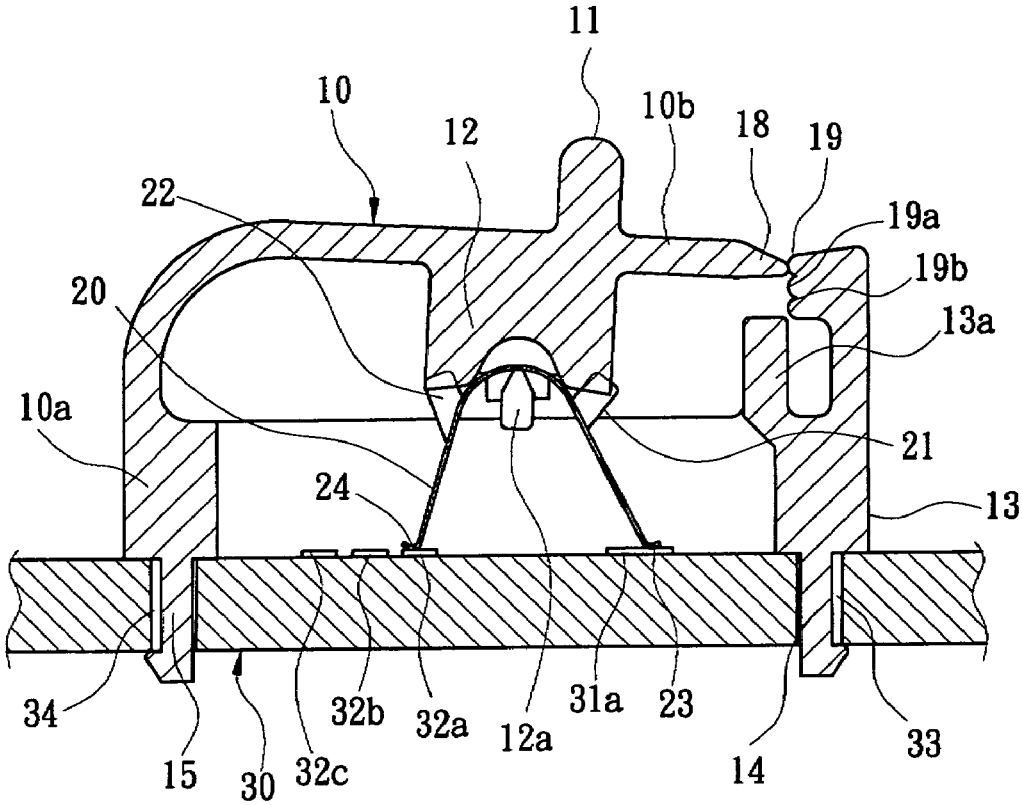
FIGS. 8A through 8D are sectional views and top views of a third embodiment of the invention in operating conditions.
Figure 8B:
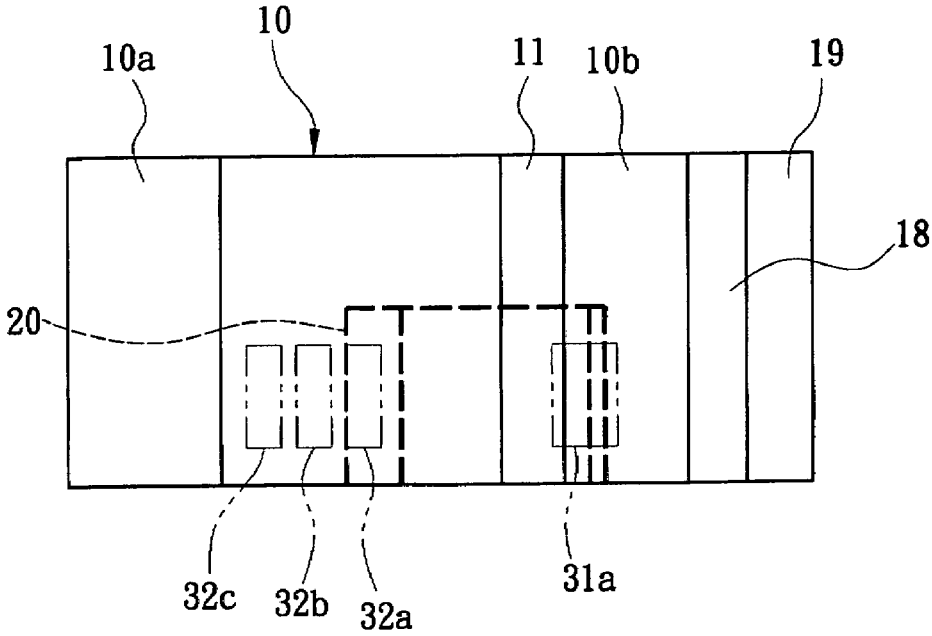
Figure 8C:
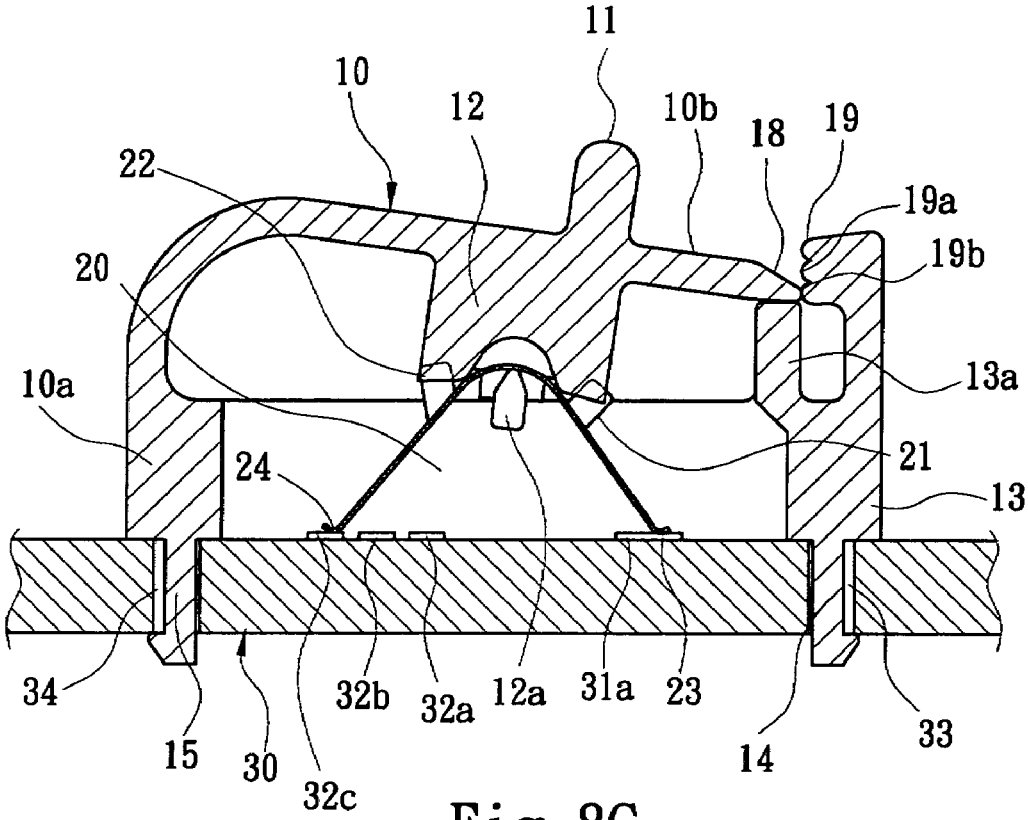
Figure 8D:
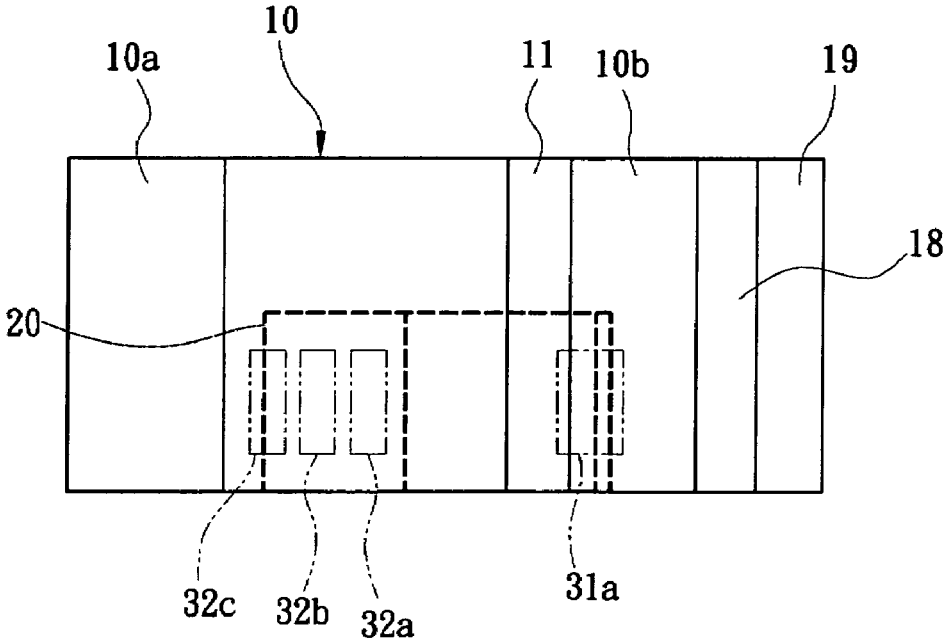

Refer to FIGS. 8A through 8D for a third embodiment of the invention in operating conditions. The sub-bracket 13 has a third pressing portion 19*a* and a fourth pressing portion 19*b*. The circuit board 30 has three sets of signal contacts 32*a*, 32*b* and 32*c* spaced from one another. The force receiving end 10*b* can receive external forces at three different stages of conductive positions to generate and output three different command signals. While the force receiving end 10*b* is moved about the bend point under the external forces towards the circuit board 30, the two legs 23 and 24 of the conductive member 20 are driven to connect the common contact 31*a* and the signal contacts 32*a*, 32*b* and 32*c* respectively to form three stages of conductive conditions to output three different command signals. The force receiving end 10*b* drives the first pressing portion 18 at the same time to press the second pressing portion 19, third pressing portion 19*a* and fourth pressing portion 19*b* in this order to generate three stages of click feeling corresponding to the three stages of conductive positions.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A simplified pushbutton switch, comprising:

a circuit board which has a signal circuit with a common contact and at least one signal contact directly on the circuit board;

a main bracket which has an anchor end on one end and a force receiving end on another end formed by extending the anchor end through at least one bend point that is movable reciprocally about the anchor end which serves as an axis;

a sub-bracket which has a second pressing portion corresponding to a first pressing portion of the main bracket, the force receiving end being movable to synchronously drive the first pressing portion to press the second pressing portion to generate a click feeling for the pushbutton switch; and a conductive member which is located on the main bracket and has at least two legs corresponding to the signal circuit;

wherein the force receiving end is movable about the bend point towards the circuit board upon receiving an external force to drive the two legs to connect the common contact and the signal contact to form a conductive condition to output at least one command signal.

2. The simplified pushbutton switch of claim 1, wherein the circuit board has a first anchor hole and the anchor end has a first retaining portion corresponding to the first anchor hole.

3. The simplified pushbutton switch of claim 1, wherein the main bracket has a holding space to hold the conductive member.

4. The simplified pushbutton switch of claim 3, wherein the holding space has a holding trough and the conductive member has a holding portion corresponding to the holding trough.

5. The simplified pushbutton switch of claim 1, wherein the force receiving end is movable reciprocally to a free position and a forced conductive position.

6. The simplified pushbutton switch of claim 5, wherein the signal contact includes a plurality of signal contact spots that are spaced from one another and the force receiving end is movable at multiple stages to varying forced conductive positions to generate and output a plurality of different command signals.

7. The simplified pushbutton switch of claim 1, wherein the main bracket further has a depressing portion formed by extending the force receiving end upwards.

8. The simplified pushbutton switch of claim 1, wherein the circuit board further has a second anchor hole and the sub-bracket has a second retaining portion corresponding to the second anchor hole.

9. The simplified pushbutton switch of claim 1, wherein the sub-bracket has a bucking portion to limit moving displacement of the first pressing portion.

10. The simplified pushbutton switch of claim 1, wherein the two legs of the conductive member are on opposite sides of a center of the conductive member and the two legs together form a curved arch shape for the conductive member.

11. The simplified pushbutton switch of claim 1, wherein the main bracket has an L-shape with the anchor end and the force receiving end being movable toward one another about the at least one bend point when the force receiving end is moved towards the circuit board.

12. The simplified pushbutton switch of claim 1, wherein the anchor end of the main bracket is mounted on the circuit board and is non-movable relative to the circuit board.

13. The simplified pushbutton switch of claim 1, wherein ends of the two legs are moveable away from each to increase a distance therebetween when the force receiving end moves toward the circuit board and the conductive condition is formed.

* * * * *